US007648231B2

(12) United States Patent
Williams et al.

(10) Patent No.: US 7,648,231 B2
(45) Date of Patent: Jan. 19, 2010

(54) SYSTEM AND METHOD FOR INSULATING SOLID INK PRINTHEADS

(75) Inventors: Antonio L. Williams, Lake Oswego, OR (US); Scott J. Phillips, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 11/093,503

(22) Filed: Mar. 30, 2005

(65) Prior Publication Data

US 2006/0227191 A1 Oct. 12, 2006

(51) Int. Cl.
*B41J 2/175* (2006.01)

(52) U.S. Cl. ..... 347/88

(58) Field of Classification Search ..... 347/29–33, 347/88, 99, 103, 22, 108
See application file for complete search history.

(56) References Cited

U.S. PATENT DOCUMENTS

| | | | | |
|---|---|---|---|---|
| 4,636,803 | A | 1/1987 | Mikalsen | |
| 4,739,339 | A | 4/1988 | DeYoung et al. | |
| 5,038,157 | A | 8/1991 | Howard | |
| 5,344,245 | A * | 9/1994 | Tajima et al. | 400/320 |
| 5,372,852 | A | 12/1994 | Titterington et al. | |
| 5,493,319 | A | 2/1996 | Hirabayashi et al. | |
| 6,053,608 | A | 4/2000 | Ishii et al. | |
| 6,293,648 | B1 | 9/2001 | Anderson | |
| 6,332,678 | B1 * | 12/2001 | Hollands | 347/88 |
| 6,578,949 | B2 | 6/2003 | Takahashi et al. | |
| 6,588,876 | B2 | 7/2003 | Taylor et al. | |
| 6,663,215 | B2 | 12/2003 | Klausbruckner et al. | |
| 6,764,160 | B1 * | 7/2004 | Phillips et al. | 347/32 |
| 6,783,221 | B2 | 8/2004 | Phillips | |
| 7,128,389 | B2 * | 10/2006 | Okamoto et al. | 347/29 |
| 2002/0170451 | A1 * | 11/2002 | Nakazawa et al. | 101/463.1 |
| 2004/0263556 | A1 * | 12/2004 | Urrutia et al. | 347/22 |

* cited by examiner

*Primary Examiner*—Stephen D Meier
*Assistant Examiner*—Alexander C Witkowski
(74) *Attorney, Agent, or Firm*—Fay Sharpe LLP

(57) ABSTRACT

An insulating assembly and method for insulating printer/copier solid ink printheads. The insulating assembly includes printhead insulators having thermal insulation capable of moving along insulator paths interposed between the printheads and an ink receiving surface for insulating the printhead front faces. The method includes moving insulating assemblies along insulator paths interposed between the printheads and an ink receiving surface for insulating the printhead front faces.

16 Claims, 9 Drawing Sheets

SYSTEM AND METHOD FOR INSULATING SOLID INK PRINTHEADS

CROSS REFERENCE TO RELATED APPLICATIONS

This application is related to U.S. patent application to Phillips, et al., Ser. No. 11/094,944 filed Mar. 30, 2005.

BACKGROUND

Illustrated herein are embodiments relating to a method and apparatus for insulating printer/copier printheads. It finds particular application in conjunction with an imaging apparatus having solid ink printheads, and will be described with particular reference thereto. However, it is to be appreciated that the present exemplary embodiment is also amenable to other like applications.

Image producing machines, such as printers and/or copiers and the like, often use printheads for ejecting ink onto an ink receiving surface, such as print media also referred to as the substrate, or an image drum which is then transferred to the print media, to form an image thereon. Solid ink image producing machines use solid ink, also referred to as phase change ink. The solid ink is in the solid phase at ambient temperature and is melted to a molten, liquid phase at an elevated, operating temperature. At the operating temperature, droplets or jets of the molten liquid ink are ejected from one or more printheads to form the image. When the ink droplets contact the surface of the substrate, they quickly solidify to create an image in the form of a predetermined pattern of solidified ink drops.

Solid ink printheads require a significant amount of energy to melt the ink and keep it in the liquid phase so that it can be ejected onto the receiving surface. However, oftentimes the device is not used continuously and it may sit idle for a significant percentage of time it is turned on. As a result, solid ink imaging devices can consume power even while sitting idle.

Today however, energy conservation is popular. Reducing the energy consumed by devices, including imaging devices, conserves natural resources and saves the owner/operator money thereby providing a valuable feature which can make the device more marketable. Many imaging devices have a low energy mode, also referred to as a sleep mode, when sitting idle for a period of time. One way to reduce the energy consumption of solid ink imaging devices is to turn off the power being used to heat the printheads while in the low energy mode. This option is not desirable because it results in thermal cycling failures at the piezo electric bonds in the heating elements used to heat the ink. It also results in significant ink usage to clear the printheads of air bubbles formed during the cool down cycle when the ink solidifies. Further it inconveniences the user with longer startup times when the machine is operated after sitting idle.

Another option to keep energy consumption low is to insulate the printheads and supply just enough power to keep the ink molten during the low energy mode. Applying thermal insulation to as many of the printhead external surfaces as possible helps to minimize the amount of energy required to maintain the ink temperature above its melting point. Insulating the front face of the printhead, however, is quite challenging because it contains the apertures through which ink is jetted onto the receiving surface and therefore, the front face of the printhead needs to be exposed to the receiving surface during normal operation. Further, the printhead front face is typically disposed in close proximity to the receiving surface when forming the image. It is desirable to solve these problems in order to reduce the energy consumed by the solid ink imaging device.

BRIEF DESCRIPTION

An insulating assembly and method for insulating printer/copier solid ink printheads is provided.

In accordance with one aspect of the embodiments described herein, the insulating assembly includes printhead insulators having thermal insulation capable of moving along insulator paths interposed between the printheads and an ink receiving surface for insulating the printhead front faces.

In accordance with another aspect of the embodiments described herein, the method includes moving insulating assemblies along insulator paths interposed between the printheads and an ink receiving surface for insulating the printhead front faces Further scope of the applicability of the embodiments provided herein will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DETAILED DESCRIPTION

Figure 1:
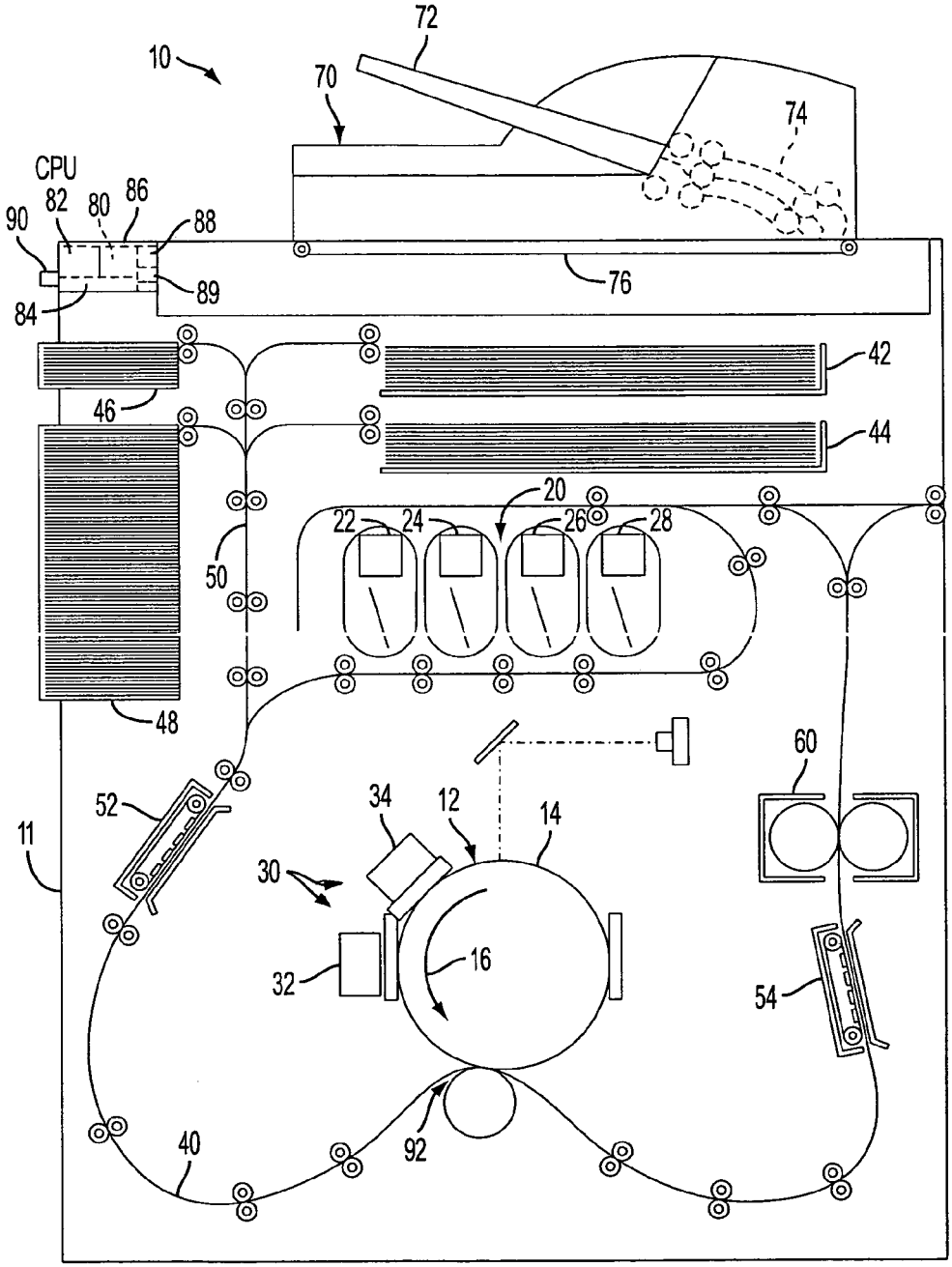
FIG. 1 is block diagram of a printer/copier.

With reference to FIG. 1, there is illustrated an image producing machine, such as the solid ink image producing machine 10, referred to herein as a printer/copier. The printer/copier 10 can be a copier, printer, or multifunction device using solid ink to form an image on a substrate as described below.

The printer/copier 10 includes a frame 11 to which are mounted directly or indirectly all its operating subsystems and components, as will be described below. To start, the printer/copier includes an imaging member 12 that is shown in the form of a drum, but can equally be in the form of a supported endless belt. The imaging member 12 has an imaging surface 14, also referred to herein as an ink receiving surface, which receives the ink ejected from printheads 30 to form images. The receiving surface 14 is movable with respect to the printheads 30 along a receiving surface path as shown by arrow 16.

The printer/copier 10 also includes a solid ink delivery subsystem 20 that has at least one source 22 of one color solid ink in solid form. The printer/copier 10 can be a multicolor image producing machine having an ink delivery system 20 which includes four sources 22, 24, 26, 28, representing four different colors CYMK (cyan, yellow, magenta, black) of solid inks. The solid ink delivery system 20 also includes a melting and control apparatus (not shown in FIG. 1) for melting or phase changing the solid ink from a solid form into a liquid form. The solid ink delivery system 20 is suitable for supplying the ink in liquid form to printheads 30 which eject the ink onto the receiving surface 14, when forming an image. In other applicable examples, the receiving surface 14 can be the substrate. In these examples, the receiving surface path 16 can be the path taken by the substrate during the image forming process which can be referred to as the substrate path, also referred to as the substrate handling path, also referred to as the paper path.

As further shown, the printer/copier 10 includes a substrate supply and handling system 40. The substrate supply and handling system 40 can include a plurality of substrate supply sources 42, 44, 46, 48, of which supply source 48, for example, is a high capacity paper supply or feeder for storing and supplying image receiving substrates in the form of cut sheets. The substrate supply and handling system 40 can include a substrate handling and treatment system 50 that has a substrate pre-heater 52, substrates and image heater 54, and a fusing device 60. The printer/copier 10 can also include an original document feeder 70 that has a document holding tray 72, document sheet feeding and retrieval devices 74, and a document exposure and scanning system 76.

Operation and control of the various subsystems, components and functions of the printer/copier 10 are performed with the aid of a controller 80. The controller 80 can be a self-contained, dedicated computer having a central processor unit (CPU) 82, electronic storage 84, and a display or user interface (UI) 86. The controller 80 can include sensor input and control means 88 as well as a pixel placement and control means 89. The CPU 82 reads, captures, prepares and manages the image data flow between image input sources such as the scanning system 76, or an online or a work station connection 90, and the printheads 30. As such, the controller 80 is the main multi-tasking processor for operating and controlling other machine subsystems and functions, including timing and operation of the insulating assembly as described below.

In operation, image data for an image to be produced is sent to the controller 80 from either the scanning system 76 or via the online or work station connection 90 for processing and output to the printheads 30. Additionally, the controller 80 determines and/or accepts related subsystem and component controls, for example from operator inputs via the user interface 86, and accordingly executes such controls. As a result, appropriate color solid forms of solid ink are melted and delivered to the printheads 30 in a known manner. Additionally, pixel placement control is exercised relative to the imaging surface 14 thus forming desired images per such image data, and receiving substrates are supplies by anyone of the sources 42, 44, 46, 48 and handled by means 50 in timed registration with image formation on the surface 14. Finally, the image is transferred within the transfer nip 92, from the receiving surface 14 onto the substrate for subsequent fusing at fusing device 60.

Figure 2:
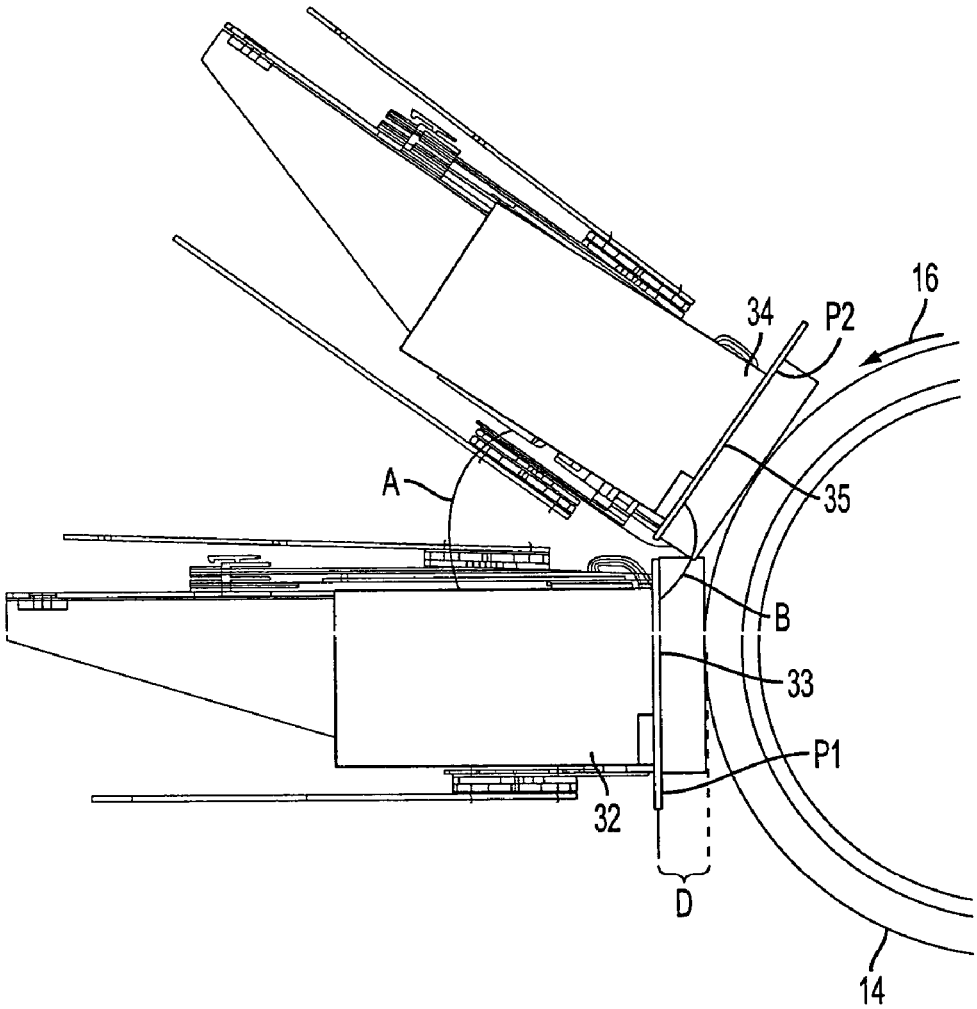
FIG. 2 is block diagram of upper and lower printheads having front faces disposed along first and second planes.
Figure 3:
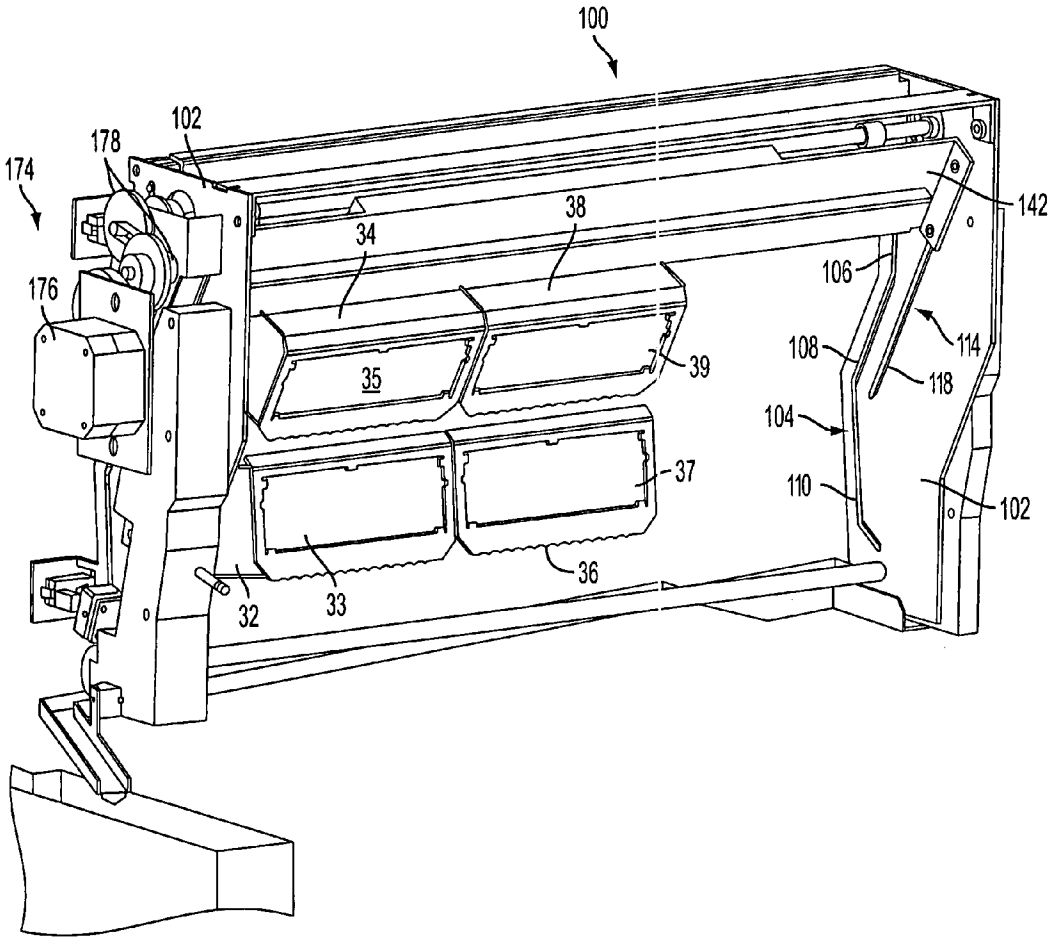
FIG. 3 is perspective view of the insulating assembly.

Referring now to FIGS. 2 and 3, the printer/copier 10 described in this example is a high-speed, or high throughput, multicolor image producing machine, having four printheads 30, including lower printheads 32 and 36, and upper printheads 34 and 38. Each printhead 32, 34, 36 and 38 has a corresponding front face 33, 35, 37 and 39 for ejecting ink onto the receiving surface 14 as the receiving surface travels along the receiving surface path 16 to form an image.

While forming an image, a mode referred to herein as print mode, the upper printheads 32, 36 are staggered with respect to the lower printheads 34, 38 in a direction transverse to the receiving surface path 16 in order to cover different portions of the receiving surface 14. The staggered arrangement enables the printheads 30 to form an image across the full width of the substrate. In print mode the printhead front faces 33, 35, 37, 39 are disposed close to the imaging surface 14, for example about 23 mils. Thus, there is little room for thermal insulation of sufficient thickness, such as for example about 0.5 inches thick, to be placed adjacent the front faces 33, 35, 37, 39 to insulate them.

When the printer/copier 10 enters the energy saving mode, which can also be referred to as a maintenance mode, the printheads 30 are moved to a energy saving position, which can also be referred to as a maintenance position. In the energy saving position the printheads 32, 34, 36, 38 are moved from their print mode staggered orientation, to an aligned orientation as shown in FIG. 3. In the aligned orientation, one or more upper printheads, in this example printheads 34 and 38, are aligned on top of corresponding one or more lower printheads, 32 and 36 respectively, to minimize heat loss. However, it should be appreciated that the upper printheads do not have to be aligned on top of the lower printheads for the insulating assembly described herein to insulated the printhead front faces as described herein. Also, in the energy saving mode, the printheads 30 are retracted, that is moved away, from the receiving surface 14 so that the printhead front faces 33, 35, 37, and 39 are disposed a distance D from the receiving surface. The distance D is greater than the distance of the printhead front faces from the provided, D is about one inch, though D can be a lesser or greater distance. The printheads can be moved by apparatus suitable for changing their position and orientation, such as those described in U.S. Pat. No. 6,764,160 B1, which is hereby incorporated by reference herein.

In the energy saving position, the upper printheads 34, 38 form an angle, shown as A, with respect to the corresponding lower printheads 32, 36. In the example provided, A is about 36°. Angle A is typically less than about 90 degrees. In the energy saving position, the lower printhead front faces 33 and 37 are disposed along a first plane, shown as P1, and the upper printhead front faces 35 and 39 are disposed along a second plane, shown as P2. The first plane P1 forms an angle, shown as B, with respect to the second plane P2. The angle B is determined to be 180°−A. In this example, B is about 144°.

The printer/copier 10 can also include an insulating assembly, shown generally at 100, for insulating the printheads 30 in the energy saving mode. The insulating assembly 100 can include printhead insulators having thermal insulation as described in further detail below. The printhead insulators are movably supported for travel along one or more insulator paths to printhead insulating positions wherein the thermal insulation is disposed adjacent to the printhead front faces 33, 35, 37, 39 for insulating them in the energy savings mode.

Figure 4:
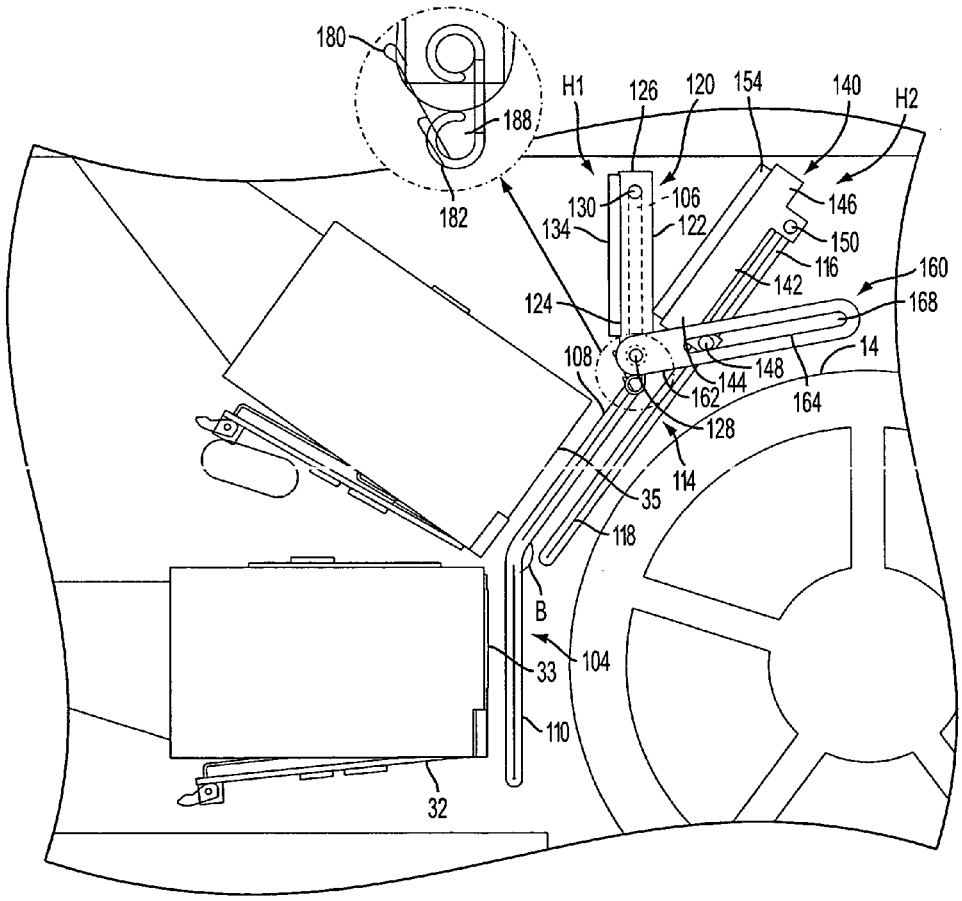
FIG. 4 is a block diagram illustrating a first embodiment of the insulating assembly having first and second printhead insulators disposed in the home positions.

Referring to FIGS. 3 and 4, the insulating assembly is shown generally at 100. The insulating assembly 100 can include one or more support plates 102 connected to the frame 11. In the example described herein, two support plates 102 are disposed in a spaced apart, approximately parallel, relationship with one on each side of the printheads 30 when the printheads are disposed in the energy saving position described above.

The insulating assembly 100 can include a first contoured track 104 having a first portion 106, a second portion 108 and a third portion 110. In the example provided herein, the contoured track 104 is formed by a contoured slot 104 in the support plates 102. For the purposes of clarity, the support plates 102 are not shown in FIGS. 4-12, although the slots forming the tracks are shown in FIGS. 4-9 and 11-12.

The contoured slot 104 can include a first slotted portion 106 (shown as a dotted line in FIG. 4), a second slotted portion 108 extending from, thereby communicating with, the first slotted portion, and a third slotted portion 110 extending from, thereby communicating with, the second slotted portion. The second portion 108 extends along the support plates 102 parallel to the second plane P2 and the third portion 110 extends along the support plates 102 parallel to the first plane P1. In the example provided, the contoured slot 104 extends through the two support plates 102, however, it should be appreciated that the contoured track 104 can be formed in other manners, such as for example, by a contoured groove, among others.

The insulating assembly 100 can include a second track 114 having a first portion 116, and a second portion 118. In the example provided herein, the second track 114 is formed by a second slot 114 in the support plates 102. The second slot 114 includes a first slotted portion 116 and a second slotted portion 118 extending from, thereby communicating with, the first slotted portion. The second portion 118 extends along the support plates 102 parallel to the second plane P2. In the example provided, the second slot 104 extends through the two support plates 102, however, it should be appreciated that the second track 114 can also be formed in other manners, such as for example, by a groove.

The insulating assembly 100 can also include a first printhead insulator 120 for insulating the one or more lower printhead front faces 33 and 37. The first printhead insulator 120 can include a car 122, referred to herein as the first car. The first car 122 includes a front end 124 and a back end 126 disposed opposite the front end. Each side of the front and back ends 124, 126 are connected to the first track 104 via pivot pins, 128 and 130 respectively. The pivot pins 128 and 130 create pivoting connections between the first track 104 and both ends 124, 126 of the first car 122 which support the first car for movement along the first track and enable the front end 124 and back end 126 to simultaneously move along different portions of the first track 104 as shall be described in further detail below.

The first printhead insulator 120 can also include thermal insulation 134 for covering the one or more lower printhead front faces 33 and 37. The thermal insulation 134 can be a single piece for covering the one or more lower printhead front faces 33 and 37, or a separate piece of insulation can be used for each lower printhead front face. The thermal insulation can be Poron® manufacture by Rogers Corporation, BISCO® manufacture by Rogers Corporation, silicone or any other thermal insulating material suitable for insulating the lower printhead front faces 33 and 37 to reduce heat loss. In the example provided, the insulation is rectangular having a width sufficient to cover the lower printhead front faces 33 and 37, a length sufficient for covering the front faces of both first printheads, and a thickness of about 0.5 inch, although other suitable dimensions for insulating the lower printhead front faces can be used.

The insulating assembly 100 can also include a second printhead insulator 140 for insulating the one or more lower printhead front faces 35 and 39. The second printhead insulator 140 can include a car 142, referred to herein as the second car. The second car 142 includes a first end 144, and a second end 146 disposed opposite the first end. Each side of the first and second ends 144, 146 are connected to the second track 114 via pivot pins, 148 and 150 respectively. The pivot pins 148 and 150 create pivoting connections between the second track 114 and both ends 144, 146 of the second car 142 thereby supporting the second car for movement along the second track.

The second printhead insulator 140 can also include thermal insulation 154 for covering the one or more second printhead front faces 35 and 39 to reduce heat loss. The thermal insulation 154 can be a single piece for covering the one or more second printhead front faces 35 and 39, or a separate piece of insulation can be used for each second printhead front face. The thermal insulation 154 can be similar to the first printhead insulator insulation 134 described above.

The insulating assembly 100 can also include a car-to-car linkage 160 for connecting the first car 122 to the second car 142. The linkage 160 can include a first end 162 pivotally connected to the first end 124 of the first car 122 via the pivot pin 128. The linkage 160 can also include a slot 164 receiving the second car pivot pin 148 for providing a sliding connection between the linkage and the second car 142. The slot 164 includes a first end 168 for abutting the pivot pin 148 at the first end 144 of the second car 142 to provide a pulling force to the second car thereby pulling the second car behind the first car 122 as the first car travels along a first insulator path IP1, as shall be described in further detail below.

Figure 5:
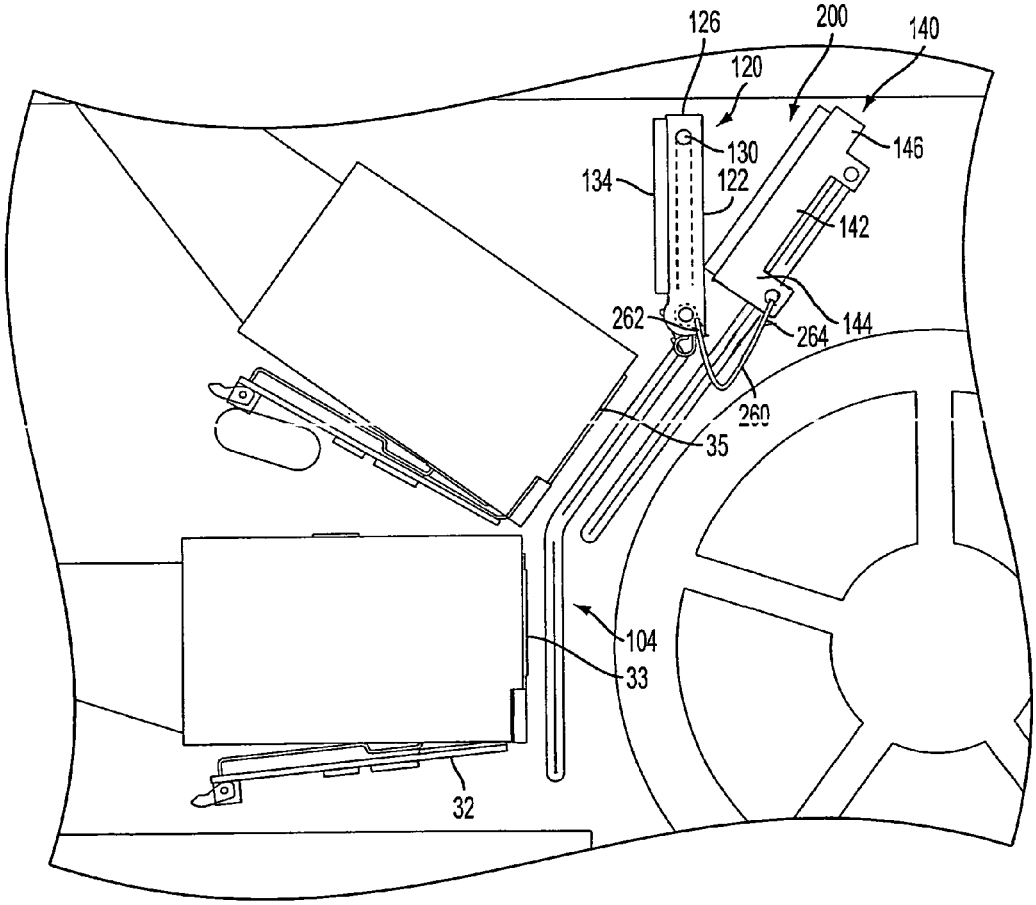
FIG. 5 is a block diagram illustrating a second embodiment of the insulating assembly.

It should be appreciated that the car-to-car linkage 160 providing the connection between the first and second cars 122, 142 is shown for the purposes of example, and other connections can be used. Referring to FIG. 5, another embodiment of the insulating assembly is illustrated at 200 in which some components similar to those shown in FIG. 4 are referenced with similar reference numerals. The second embodiment 200 includes a car-to-car linkage 260 connecting the first car 122 to the second car 142 that is a flexible cable. The flexible cable 260 provides little to no stretch axially along it's length. In this embodiment, the flexible cable 260 is formed of wire having a first end 262 connected to the first end 124 of the first car 122 and a second end 264 connected to the first end 144 of the second car 142. The flexible cable 260 has a length that is approximately longer than the first car 122, sufficient to allow the second car 142 to be pulled behind the first car 122 as the first car moves along the first insulator path IP1.

The insulating assembly 100 can also include a spring 170 (shown in FIG. 6) connected to the second car 142 for biasing the second car towards the home position H2 as shown by arrow S and described in further detail below. The spring 170 can be an extension spring, a compression spring, a clock spring or any other spring suitable for biasing the second car 142 in the home position H2.

Referring again to FIG. 3, the insulating assembly 100 can also include a drive mechanism 174 for moving the first car 122 along the track 104. The drive mechanism 174 can include a motor 176 connected to the first car 122 by a drive belt 178. The operation of the motor 176 is controlled by the controller 80.

Referring again to FIG. 4, the insulating assembly 100 can also include a wiper 180 for wiping the printhead front faces 33, 35, 37, 39 to remove ink, such as for example waste ink, and debris. The wiper 180 can be formed of a resilient material such as vinyl, rubber, or silicone, among others. The wiper 180 can be attached to a third car 182 pivotally connected to the first car 142 via a pivot connector, such as pivot pin 128. The third car 182 can be connected to the first track 104 via a second pivot pin 188.

The operation of the printhead insulator assembly 100 shall be described with reference to FIGS. 4, and 6-10. In references 4-12, only printheads 32 and 34 and respective printhead front faces 33 and 35 are shown for clarity, however it should be appreciated that printheads 36 and 38 and respective printhead front faces 37 and 39 are also being acted upon by the insulating assembly 100, 200, 300, and 400 in a similar manner. Referring to now FIG. 4, the first printhead insulator 120 is disposed in a first printhead insulator home position H1 and the second printhead insulator 140 is disposed in a second printhead insulator home position H2 during print mode. In the home positions H1 and H2, the first and second printhead insulators 120, 140 are stacked together to occupy less space, and are located away from the printheads 30 and not interposed between the printheads and the receiving surface 14, as shown, so as not to interfere with the printheads during printing. When the printer/copier 10 is switched from print mode to energy saving mode, the controller 80 initiates operation of the drive unit 174 which moves the first car 122 along the first track 104 moving the first printhead insulator 120 along the first insulator path shown as the dotted line IP1 in FIG. 6. The first printhead insulator 120 is moved along the first insulation path IP1 from the first printhead insulator home position H1 to a first printhead insulating position I1 (shown in FIG. 9), wherein the thermal insulation 134 is disposed adjacent to the first printhead front face 33 for insulating it. The insulation path IP1 taken by the first printhead insulator 120 is interposed between the first printhead front face 33 and the receiving surface 14.

Figure 6:
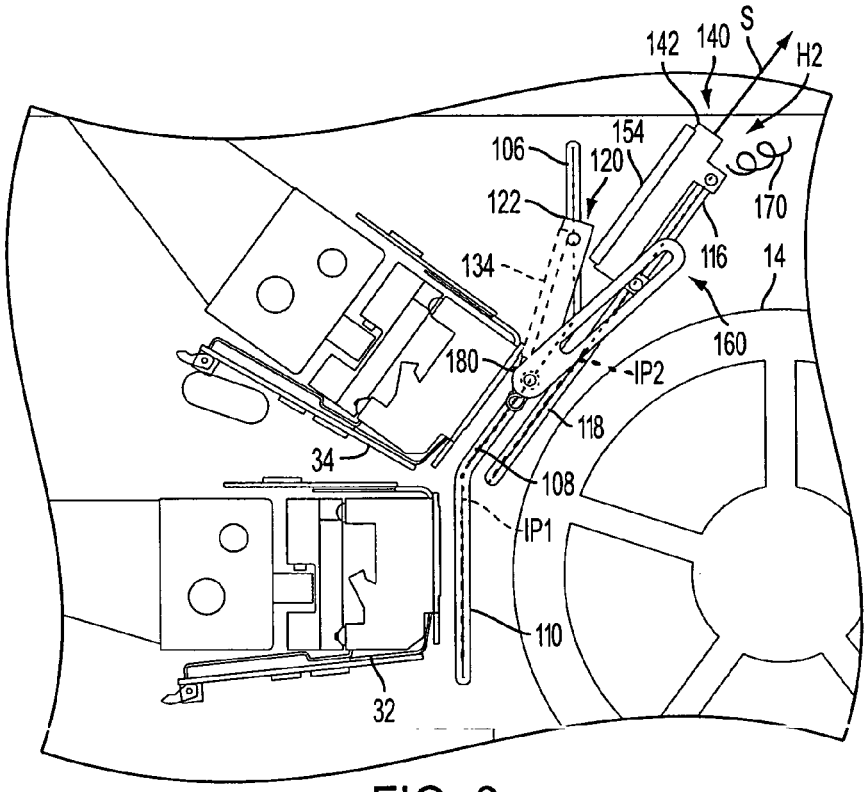
FIG. 6 is a block diagram illustrating the first printhead insulator moving along the first insulator path.

As the first car 122 travels along the first track 104 it pulls the second car 142 along the second track 114 moving the second printhead insulator 140 along a second insulation path, shown as the dotted line IP2 in FIG. 6, from the second printhead insulator home position H2 to a second printhead insulating position 12 (shown in FIG. 9), wherein the thermal insulation 154 is disposed adjacent to the second printhead front face 35 for insulating it. The second printhead insulation path IP2 is interposed between the second printhead front face 35 and the receiving surface 14.

Referring to FIG. 6, the first printhead insulator 120 is shown moving along the first insulation path IP1 away from the first insulator home position H1, and the pivot pin 128 is moving along the second portion 108 of the first track 104. The second printhead insulator 140 has not yet been pulled away from the second printhead insulator home position H2 by the first car 122. The wiper 180 is shown wiping the upper printhead front faces 35, 39 for removing ink therefrom. Since the second portion 108 of the first track 104 is parallel to the second plane P2, and thus the upper printhead front faces 35, 39, the wiper 180 provides a relatively constant wiping pressure against the front face as it wipes across them.

Figure 7:
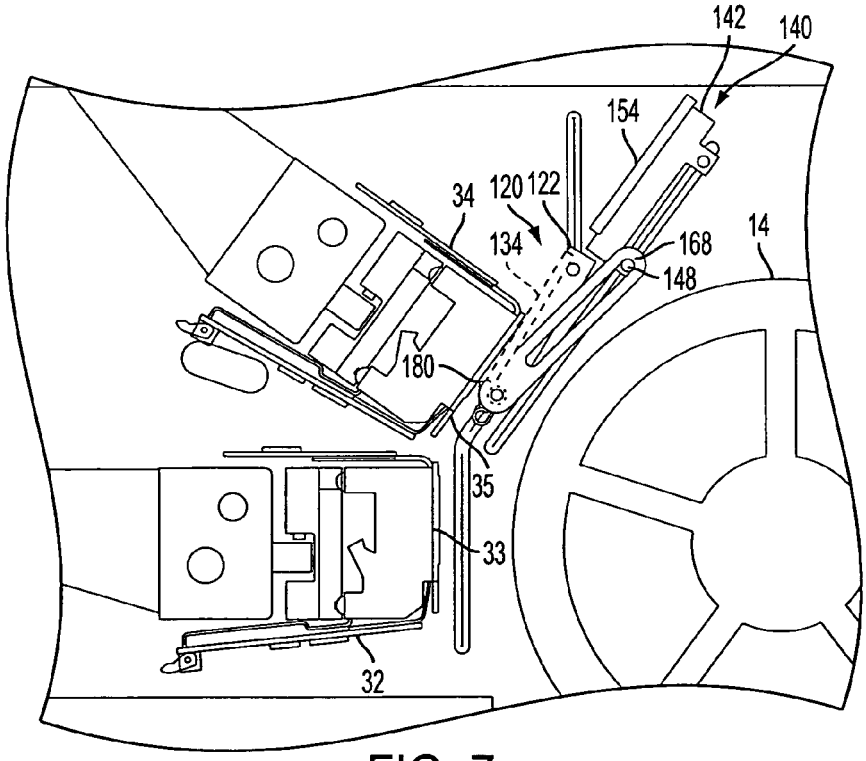
FIG. 7 is a block diagram illustrating the first and second printhead insulators moving along the first and second insulator paths.

Referring now to FIG. 7, the first car 122 begins to pull the second car 142 away from the second printhead insulator home position H2 via the linkage 160 or 260. In the embodiment 100 having the slotted linkage 160, the first end 168 of the slot 164 abuts the second car pivot pin 148 to transfer the pulling force from the first car 122 to the second car 142. In the embodiment 200 having the flexible linkage 260, the flexible linkage pulls taught and then begins to transfer this pulling force to pull the second car 142.

Figure 8:
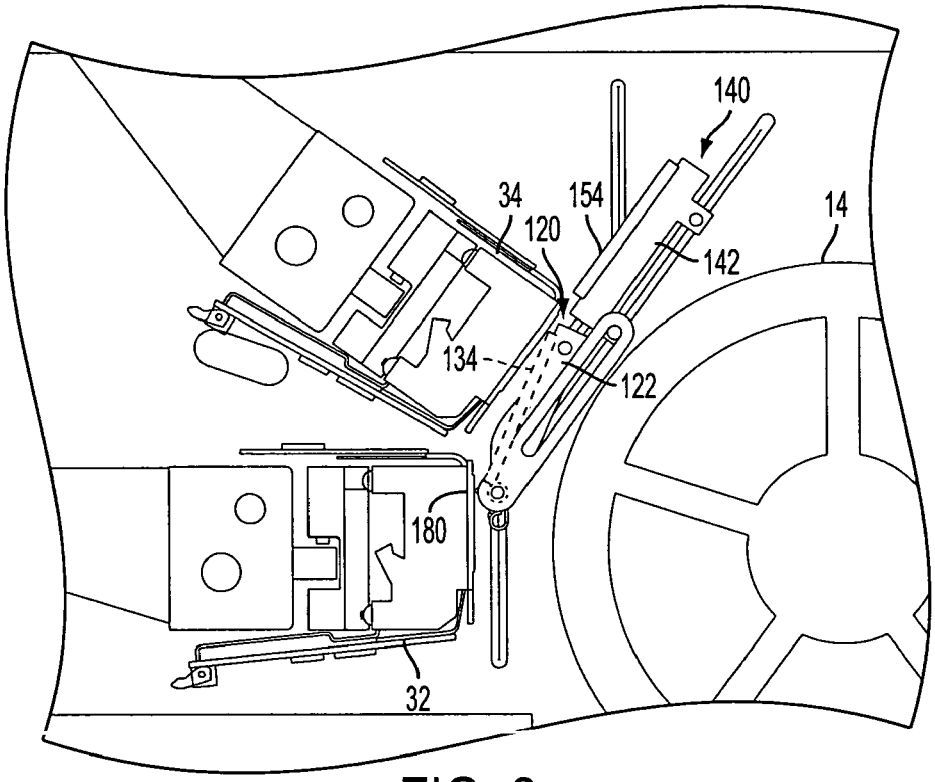
FIG. 8 is a block diagram illustrating the first and second printhead insulators moving along the first and second insulator paths.

Referring now to FIG. 8, the front of the first car 122 enters the third portion 110 of the first tack 104 and the wiper 180 begins to wipe the lower printhead front faces 33, 37. Since the third portion 110 of the first track 104 is parallel to the first plane P1, and thus the lower printhead front faces 33, 37 the wiper 180 provides a relatively constant wiping pressure against these front faces as it wipes across them.

Figure 9:
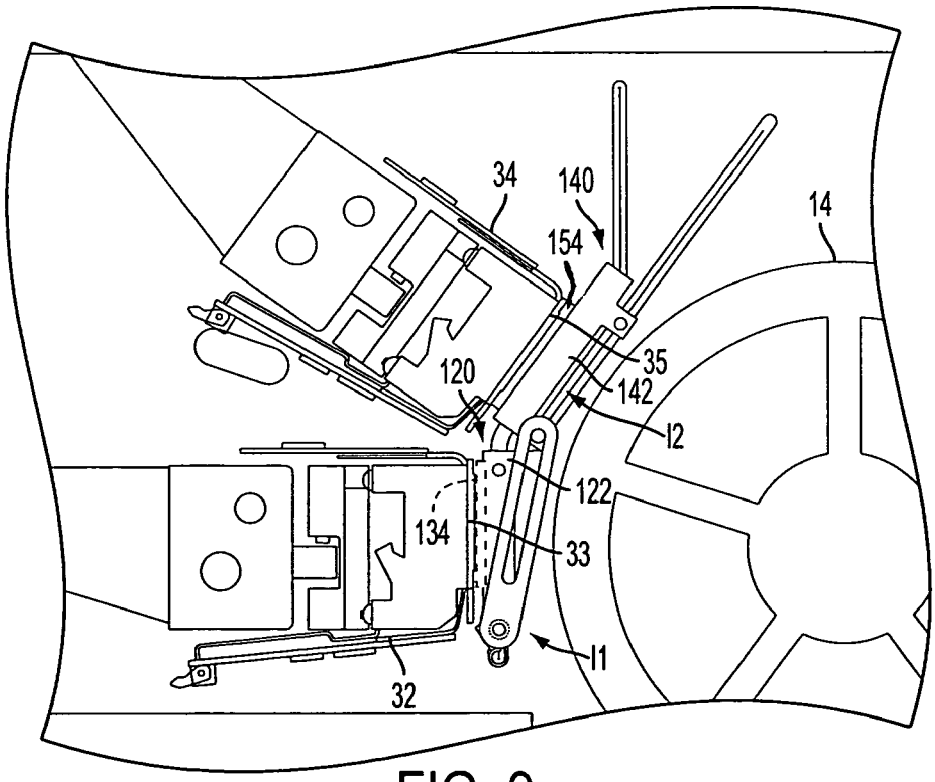
FIG. 9 is a block diagram illustrating the first and second printhead insulators in the first and second printhead insulating positions.

In FIG. 9, the first printhead insulator 120 has reached the first insulation position I1 wherein the thermal insulation 134 is disposed adjacent to the lower printhead front faces 33, 37 for insulating them. Further, second printhead insulator 140 has reached the second insulation position 12 wherein the thermal insulation 154 is disposed adjacent to the upper printhead front faces 35, 39 for insulating them. When the printer/copier 10 is switched back to the print mode for forming an image on the receiving surface 14, the controller 80 causes the drive unit 174 to move the first car 122 back in the opposite direction along the first insulation path IP1 returning the printhead insulator 120 back to the first insulator home position H1. The second car 142, aided by the force applied by spring 170, moves back along the second insulation path IP2 returning the second printhead insulator 140 back to the second insulator home position H2.

Figure 10:
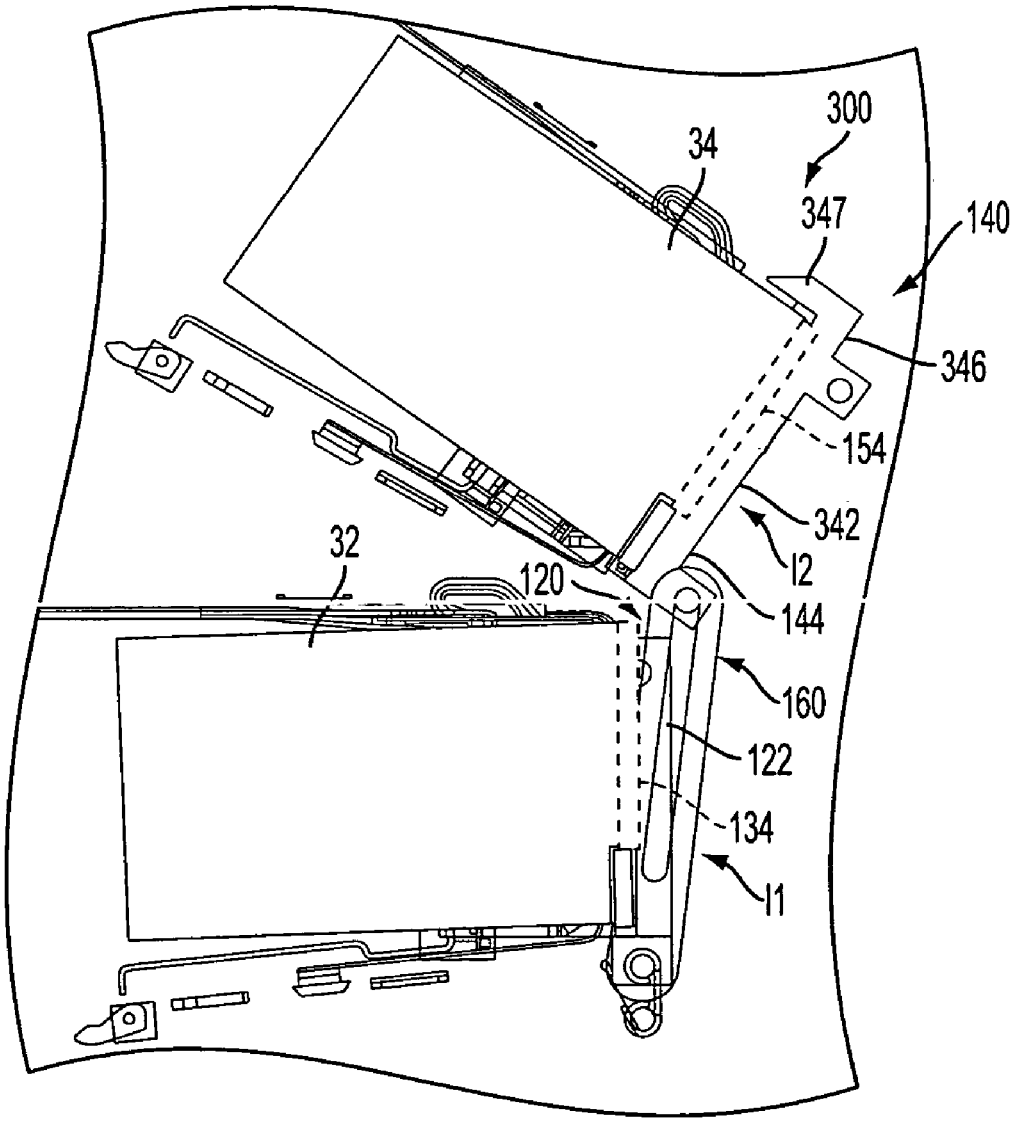
FIG. 10 is a block diagram illustrating a third embodiment of the insulating assembly.

Referring now to FIG. 10, another embodiment of the insulating assembly is shown generally at 300 in which some of the similar components as those described above are shown with similar reference numerals. The second printhead insulator 140 includes a cap 347 extending from the second end 346 of the second car 322 for improving the insulating ability of the second printhead insulator. The cap 347 extends up from the second car 342, away from the insulating track, to cover the upper edge of the upper printhead front faces 35, 39 and adjacent portions of the upper printheads 34, 38.

Figure 11:
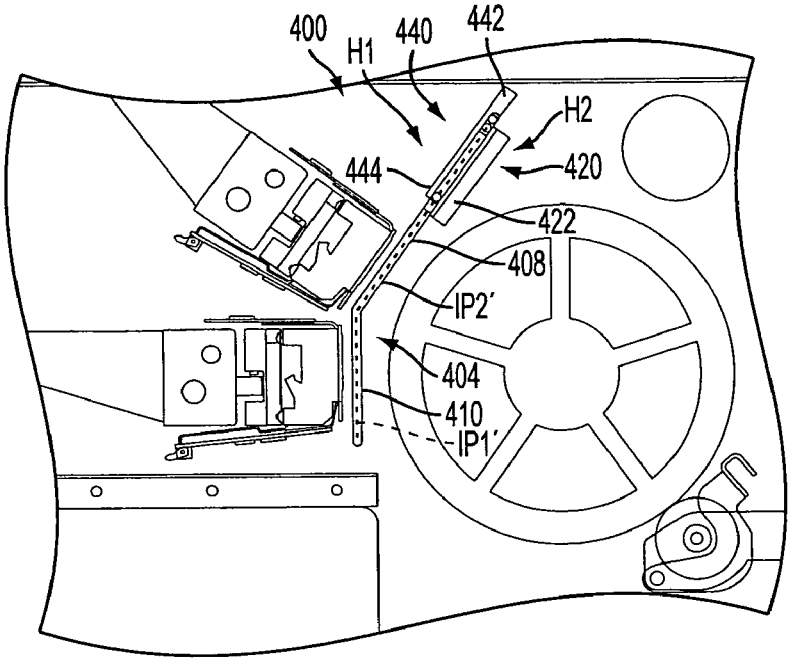
FIG. 11 is a block diagram illustrating a third embodiment of the insulating assembly with the first and second printhead insulators disposed in the home positions.
Figure 12:
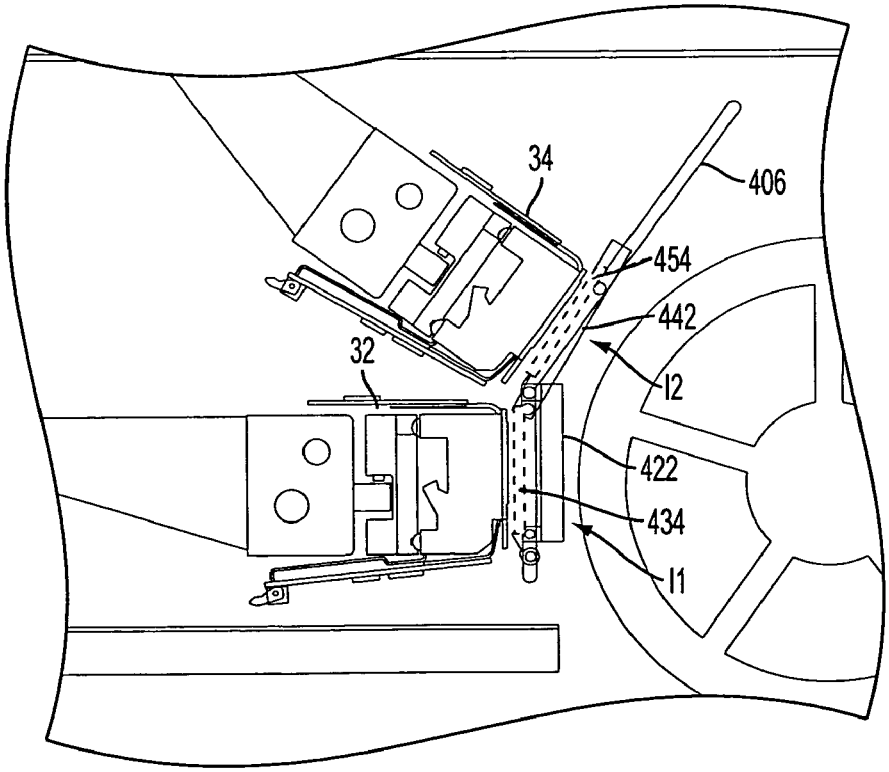
FIG. 12 is a block diagram illustrating the third embodiment of the insulating assembly with the first and second printhead insulators disposed in the first and second printhead insulating positions.

Referring now to FIGS. 11 and 12, another embodiment of the insulating assembly is shown generally at 400. The insulating assembly 400 can include a first printhead insulator 420 having a first car 422 and thermal insulation 434. The insulating assembly 400 can also include a second printhead insulator 440 having a second car 442 and thermal insulation 454. The insulating assemble can include a single track 404 having a first portion 408 extending parallel to the second plane P2 described above, and a second portion 410 extending parallel to the first plane P1 described above.

The first printhead insulator 420 is stacked with the second printhead insulator 440 while they occupy their corresponding home positions H1 and H2 as shown in FIG. 11 to reduce the space they occupy in the printer/copier 10. Upon entering the energy saving mode, the first printhead insulator 420 is moved along the first insulator path IP1' from the home position H1 to the first printhead insulating position I1 as the drive unit moves the first car 422 along the track 404. The rear end 426 of the first car 422 is connected to the front end 444 of the second car 442 for pulling it by placing the first car pivot pin 430 behind (that is, closer to the home positions H1, H2 than the insulating positions 11, 12) the second car pivot pin 448. The first car 422 is moved towards the first printhead insulating position I1 while the second car 442 remains in the home position H2 until the rear of the first car 422 abuts the front of the second car 442 and pulls it along the track 404.

The advantages of the insulating assembly 100, 200, 300, 400 described herein include insulating one or more upper and lower printhead front faces disposed in different planes while occupying a minimal space within the printer/copier 10.

The operation of the embodiments described herein illustrate a method for insulating the solid ink printheads 33, 34, 36, 38 having front faces 33, 35, 37, 39 disposed in different planes. The method can include the operation of these embodiments as described above, including moving a first printhead insulator having thermal insulation along a first insulator path interposed between the first printhead and the receiving surface from a first printhead insulator home position to a first printhead insulating position wherein the thermal insulation is disposed adjacent to the first printhead front face for insulating it. The method can also include moving a second printhead insulator having thermal insulation and connected to the first printhead insulator for travel along a second insulator path interposed between the second printhead and the receiving surface from a second printhead insulator home position to a second printhead insulating position wherein the thermal insulation is disposed adjacent to the second printhead front face for insulating it.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An insulating assembly for insulating solid ink printheads including an upper printhead having a front face disposed in a first plane for ejecting ink onto a receiving surface and a lower printhead having a front face disposed in a second plane different than the first plane and forming an angle with the first plane for ejecting ink onto the receiving surface, the insulating assembly comprising:

a first printhead insulator having a car having a front end pivot connection, a back end pivot connection and thermal insulation;

a track having a first portion extending parallel to the first plane and a second portion extending parallel to the second plane, the track supporting the first printhead insulator car front end pivot connection and back end pivot connection for travel of the first printhead insulator car along a first insulator path interposed between the upper printhead and the receiving surface from a first printhead insulator home position not interposed between the upper printhead front face and the receiving surface to a first printhead insulating position wherein the thermal insulation is disposed adjacent to the upper printhead front face for insulating same; and a second printhead insulator having a car having thermal insulation and connected to the first printhead insulator car for travel along a second insulator path interposed between the lower printhead and the receiving surface from a second printhead insulator home position not interposed between the lower printhead front face and the receiving surface to a second printhead insulating position wherein the thermal insulation is disposed adjacent to the lower printhead front face for insulating same, wherein the first printhead insulator and the second printhead insulator are stacked together in the home positions and unstacked in the corresponding first and second printhead insulating positions.

2. The insulating assembly defined in claim 1, further comprising a pair of spaced apart support plates having contoured grooves forming the track.

3. The insulating assembly defined in claim 1, the track further comprising:

a first portion;

a second portion communicating with the first portion and extending parallel to the second plane; and a third portion communicating with the second portion and extending parallel to the first plane.

4. The insulating assembly defined in claim 1 further comprising:

a drive unit connected to the first printhead insulator car for moving the first insulator along the first insulator path.

5. The insulating assembly defined in claim 1 wherein the second printhead insulator car includes a front end pivot connection and a back end pivot connection connected to the track for travel along the second insulator path.

6. The insulating assembly defined in claim 5 further comprising a linkage for connecting the first printhead insulator car and the second printhead insulator car, the linkage comprising:

a first end pivotally connected to a front end of the first printhead insulator car; and a slot receiving a pivot pin connected to the front end pivot connection of the second printhead insulator car, the slot having a first end for abutting the pivot pin to provide a pulling force to the second printhead insulator car for pulling the second printhead insulator car behind the first printhead insulator car as the first printhead insulator car travels along the first insulator path from the first printhead insulator home position to the first printhead insulating position.

7. The insulating assembly defined in claim 5 further comprising a flexible linkage connecting a front end of the first printhead insulator car and a front end of the second printhead insulator car.

8. The insulating assembly defined in claim 1 further comprising:

a second track different than the first track for guiding the second printhead insulator along the second insulator path.

9. The insulating assembly defined in claim 1 further comprising:

a spring connected to the second car for biasing the second car in the second insulator home position.

10. The insulating assembly defined in claim 1 further comprising a third car connected to the first car, the third car having a wiper for wiping the first and second printhead front faces as the first car moves along the first insulator path.

11. The insulating assembly defined in claim 1 further comprising a linkage connecting a front end of the first printhead insulator car to a front end of the second printhead insulator car.

12. A printer/copier comprising:

an upper printhead having a front face disposed along a first plane for ejecting ink onto a receiving surface;

a lower printhead having a front face disposed along a second plane different than the first plane and forming an angle with the first plane for ejecting ink onto the receiving surface; and an insulating assembly comprising:

a first printhead insulator car having a front end a back end and thermal insulation, a track having a first portion extending parallel to the first plane and a second portion extending parallel to the second plane supporting the first printhead insulator car front end and back end for travel along a first insulator path interposed between the lower printhead front face and the receiving surface from a first printhead insulator home position not disposed between the upper printhead front face and the receiving surface to a first printhead insulating position wherein the thermal insulation is disposed adjacent to the upper printhead front face for insulating same, and a second printhead insulator car having thermal insulation and connected to the first printhead insulator for travel along a second insulator path interposed between the second printhead and the receiving surface from a second printhead insulator home position not disposed between the lower printhead front face and the receiving surface to a second printhead insulating position wherein the thermal insulation is disposed adjacent to the lower printhead front face for insulating same, wherein the first printhead insulator and the second printhead insulator are stacked together in the home positions and unstacked in the corresponding first and second printhead insulating positions.

13. The printer/copier defined in claim 12, the track further comprising:

a first portion;

a second portion communicating with the first portion and extending parallel to the second plane; and a third portion communicating with the second portion and extending parallel to the first plane.

14. The printer/copier defined in claim 12 further comprising a linkage connecting a front end of the first printhead insulator car to a front end of the second printhead insulator car.

15. The printer/copier defined in claim 14 wherein the linkage further comprises:

a first end pivotally connected to a front end of the first printhead insulator car; and a slot receiving a pivot pin connected to a front end pivot connection of the second printhead insulator car, the slot having a first end for abutting the pivot pin to provide a pulling force to the second printhead insulator car for pulling the second printhead insulator car behind the first printhead insulator car as the first printhead insulator car travels along the first insulator path from the first printhead insulator home position to the first printhead insulating position.

16. The printer/copier defined in claim 14 wherein the linkage is a cable.

* * * * *